US011731027B2

(12) United States Patent
Salton-Jones

(10) Patent No.: US 11,731,027 B2
(45) Date of Patent: Aug. 22, 2023

(54) IMPACT RESISTANT HEADGEAR

(71) Applicant: Tracy Salton-Jones, San Diego, CA (US)

(72) Inventor: Tracy Salton-Jones, San Diego, CA (US)

( * ) Notice: Subject to any disclaimer, the term of this patent is extended or adjusted under 35 U.S.C. 154(b) by 220 days.

(21) Appl. No.: 17/073,616

(22) Filed: Oct. 19, 2020

(65) Prior Publication Data

US 2021/0113913 A1 Apr. 22, 2021

Related U.S. Application Data

(60) Provisional application No. 62/916,312, filed on Oct. 17, 2019.

(51) Int. Cl.

| | |
|---|---|
| ***A42B 3/04*** | (2006.01) |
| ***A63B 71/10*** | (2006.01) |
| ***A42B 3/12*** | (2006.01) |
| ***A42B 3/08*** | (2006.01) |

(52) U.S. Cl.

CPC ..... *A63B 71/10* (2013.01); *A42B 3/0453* (2013.01); *A42B 3/08* (2013.01); *A42B 3/121* (2013.01); *A63B 2220/801* (2013.01); *A63B 2244/102* (2013.01)

(58) Field of Classification Search

CPC . A63B 71/10; A63B 2244/102; A42B 3/0453; A42B 3/08; A42B 3/121

See application file for complete search history.

(56) References Cited

U.S. PATENT DOCUMENTS

| | | | | |
|---|---|---|---|---|
| 3,866,909 A * | 2/1975 | DeSantis | A42B 3/0433 2/466 |
| 4,824,107 A * | 4/1989 | French | G01P 15/09 482/84 |
| 6,056,674 A * | 5/2000 | Cook | A63B 71/12 482/90 |
| 8,696,422 B1 * | 4/2014 | Santiago | A63B 71/10 273/455 |
| 2019/0248275 A1 * | 8/2019 | Cook | B62J 6/056 |
| 2020/0188758 A1 * | 6/2020 | Song | A63B 71/0605 |

* cited by examiner

*Primary Examiner* — Tajash D Patel
(74) *Attorney, Agent, or Firm* — Andrew S. Rapacke

(57) ABSTRACT

A headgear apparatus is disclosed comprising a molded headgear apparatus which includes a cushioned core component to provide impact resistance during an activity. The headgear is configured to be low-profile to reduce the loss of vision caused by thick headgear which extends away from the face. The headgear may be molded to the facial contour of the user to provide complete protection from cuts, scrapes, swelling, and impact encountered in impact sports, such as martial arts, football, or other sports wherein impact to the head region is possible.

19 Claims, 3 Drawing Sheets

IMPACT RESISTANT HEADGEAR

CROSS-REFERENCE TO RELATED APPLICATIONS

The present application claims priority to U.S. Provisional Patent Application 62/916,312 filed on Oct. 17, 2019, entitled "IMPACT RESISTANT HEADGEAR" the entire disclosure of which is incorporated by reference herein.

TECHNICAL FIELD

The embodiments generally relate to personal protective equipment and, more specifically, relate to impact resistant headgear utilized in impact sports or activities.

BACKGROUND

Impact sports are very popular in today's culture; however, there is significant risk in partaking in such activities due to the frequency and severity of impact to the head. To mitigate these risks, headgear is often worn in impact sports, such as boxing.

Headgear is typically comprised of a padded helmet worn on the head of an athlete engaging in high-risk activities, such as various forms of martial arts. The headgear worn by the martial artists is designed to protect against cuts, scrapes, and swelling; however, the headgear in the current arts does not protect well against concussions caused by abrasive impact to the head region. Further, the various forms of headgear known in the arts are bulky, resulting in a reduced field-of-vision for the fighter. This loss in vision is dangerous as it may result in the fighter not seeing a coming strike in their periphery.

In the current arts, headgear is often constructed of molded and dipped foam, which is covered with a textile or leather. The headgear is designed to protect against inadvertent impact as well as jarring caused by strikes to the head region of the martial artist.

SUMMARY OF THE INVENTION

This summary is provided to introduce a variety of concepts in a simplified form that is further disclosed in the detailed description of the embodiments. This summary is not intended to identify key or essential inventive concepts of the claimed subject matter, nor is it intended for determining the scope of the claimed subject matter.

The embodiments provided herein relate to lightweight and impact-resistant headgear having a cushioned core component adapted to reduce the impact from a strike to the head of the user. The headgear is configured to be low-profile to reduce the loss of vision caused by thick headgear, which extends away from the face. The headgear may be molded to the facial contour of the user to provide complete protection from cuts, scrapes, swelling, and impact encountered in impact sports, such as martial arts, football, or other sports wherein impact to the head region is possible.

In one aspect, the cushioned core component is comprised of a gel having suitable qualities for reducing the impact caused by a strike to the headgear.

In one aspect, the headgear is comprised of one or more speakers to emit a sound to the user or to persons surrounding the fighter such as the coaches, judges, referees, and spectators.

In one aspect, the headgear is comprised of a digital display to display a message, advertisement, or like message. The digital display is positioned on the external surface of the headgear such that the display is visible by coaches, judges, referees, and spectators alike.

In one aspect, the digital display and the speakers are in communication with a microprocessor to execute instructions stored in a memory module.

In one aspect, the headgear is provided with an attachment mechanism to permit the headgear to interface with a helmet or other personal protective equipment worn by the user.

In one aspect, the sensor array may include at least one accelerometer, at least one gyroscope, at least one moisture sensor, and at least one piezoelectric sensor.

BRIEF DESCRIPTION OF THE DRAWINGS

A complete understanding of the present embodiments and the advantages and features thereof will be more readily understood by reference to the following detailed description when considered in conjunction with the accompanying drawings wherein.

DETAILED DESCRIPTION

Figure 1:
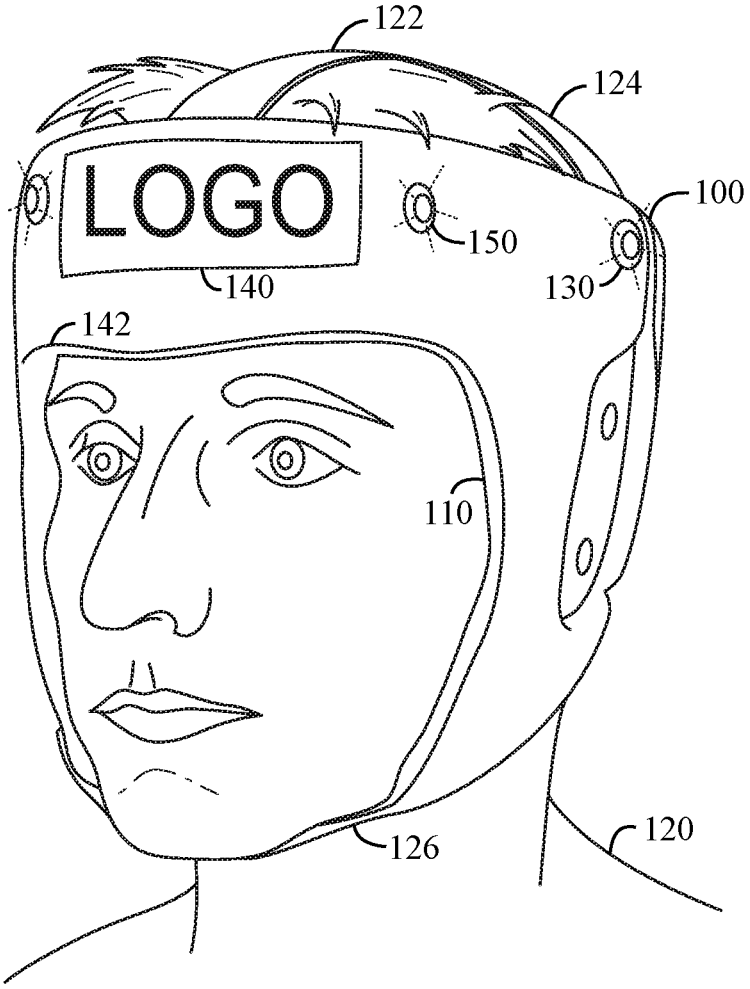
FIG. 1 illustrates a perspective view of the headgear worn by the user, according to some embodiments.

The specific details of the single embodiment or variety of embodiments described herein are to the described device. Any specific details of the embodiments are used for demonstration purposes only, and no unnecessary limitations or inferences are to be understood therefrom.

Before describing in detail exemplary embodiments, it is noted that the embodiments reside primarily in combinations of components of the device. Accordingly, the device components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

In general, the embodiments provided herein relate to a lightweight and impact-resistant headgear apparatus having a cushioned core component adapted to reduce the impact from a strike to the head of the user. The headgear is configured to be low-profile to reduce the loss of vision caused by thick headgear, which extends away from the face. The headgear may be molded to the facial contour of the user to provide complete protection from cuts, scrapes, swelling, and impact encountered in impact sports, such as martial arts, football, or other sports wherein impact to the head region is possible.

In reference to FIG. 1, the headgear 100 is shown in an exemplary embodiment. The headgear includes a cushioned core component 110, which reduces impact experienced by the user 120. The cushioned core component 110 may be comprised of a gel or similar material known in the arts to have energy absorbing or energy dissipating qualities. The cushioned core component 110 is configured to provide the low-profile dimensions of the headgear 100, which significantly increases impact resistance and field-of-vision of the user 120.

In some embodiments, one or more head straps 122,124 may be provided to retain the headgear 100 in a suitable position on the user's 120 head. Further, a chinstrap 126 extends beneath the user's 120 chin to retain the headgear 100 in a suitable position on the user's 120 head.

In further reference to FIG. 1, the headgear 100 may include one or more speakers 130 to emit sounds to the user 120, spectators, referees, judges, coaches, or others within an audible distance of the user 120. For example, the one or more speakers 130 may emit sounds related to the activity of the user 120, such as encouraging statements during a martial arts bout, taunting between the participants of the bout, messages from the coaches, judges, and/or referees, or other messages. One skilled in the arts will readily understand that the speakers 130 may be utilized in various ways for each activity performed by the user 120. The headgear 100 may also include a digital display 140 positioned on the exterior surface 142 to display a message, advertisement, or other communication. For example, the digital display 140 may be utilized to display a message to the spectators. The headgear 100 may also include one or more lights 150 to emit light while the headgear 100 is in use. For example, the lights 150 may flash upon a strike to the headgear 100. A microprocessor is in operable communication with a memory module to store instructions for controlling the display 140 and speakers 130 provided with the headgear 100.

In some embodiments, the display 140 counts each impact to the user 120 and displays the total amount of impacts. The impact count may be reset at any time during use such that impacts are counted over the duration of a fighting bout, a particular round, or other predetermined length of time.

In some embodiments, the headgear 100 is comprised of an attachment mechanism to permit the interface between the headgear and personal protective equipment worn by the user. The personal protective equipment may include helmets, facemasks, eyewear, face shields, neck braces, or other personal protective equipment known in the arts.

The headgear 100 may be constructed of various materials known in the arts of personal protective equipment and especially in the arts of headgear used in impact activities. The headgear 100 is not limited to a particular configuration, color, and size. The headgear 100 may be used in various activities in which impact to the head region is possible.

Figure 2:
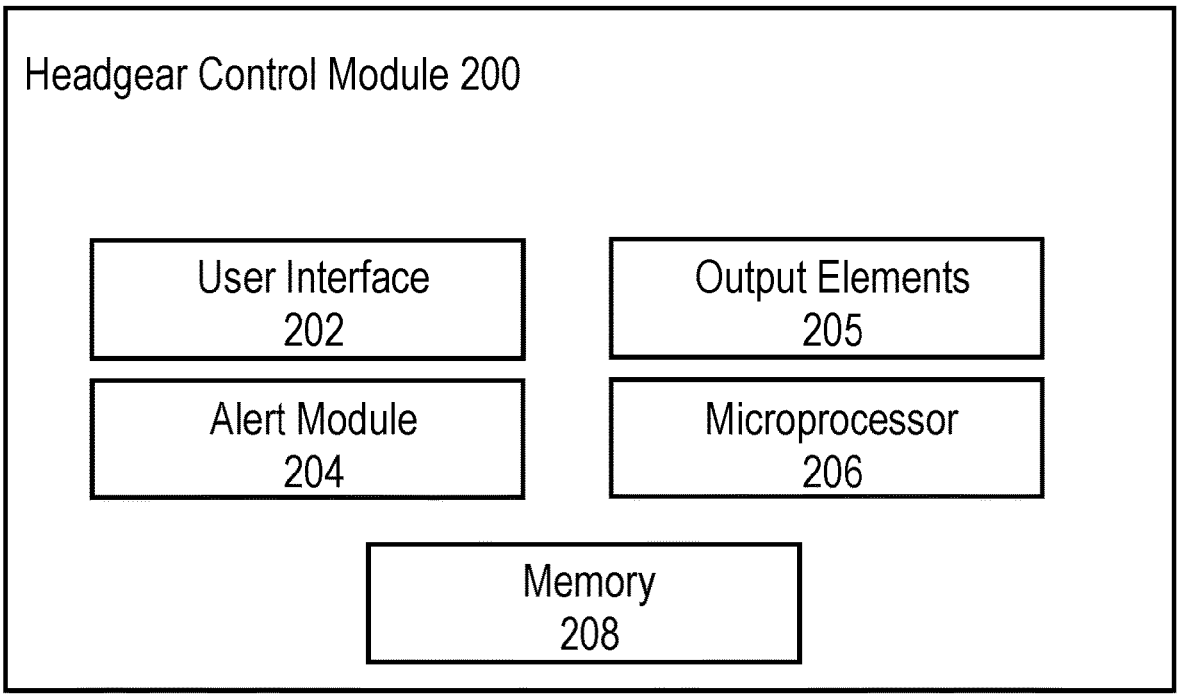
FIG. 2 illustrates a block diagram of the headgear control module, according to some embodiments.

FIG. 2 illustrates a block diagram of the headgear control module 200 including a user interface 202, which may be provided on the headgear 100, or in a remote location from the headgear 100 to allow for remote control of the various functionalities of the headgear 100. An alert module 204 receives input from a plurality of sensors positioned on or in a communicable range of the headgear 100. The sensors within the sensor array may output an alert signal to the alert module 204, which operates the one or more output elements 205 (e.g., the one or more lights 150, one or more speakers 130, and/or the one or more displays 140). A microprocessor 206 is in operable communication with the headgear control module 200 and a memory 208 to store operational processes performed by the output elements 205 (e.g., flashing light sequences, sound sequences and tones, and combinations thereof).

Figure 3:
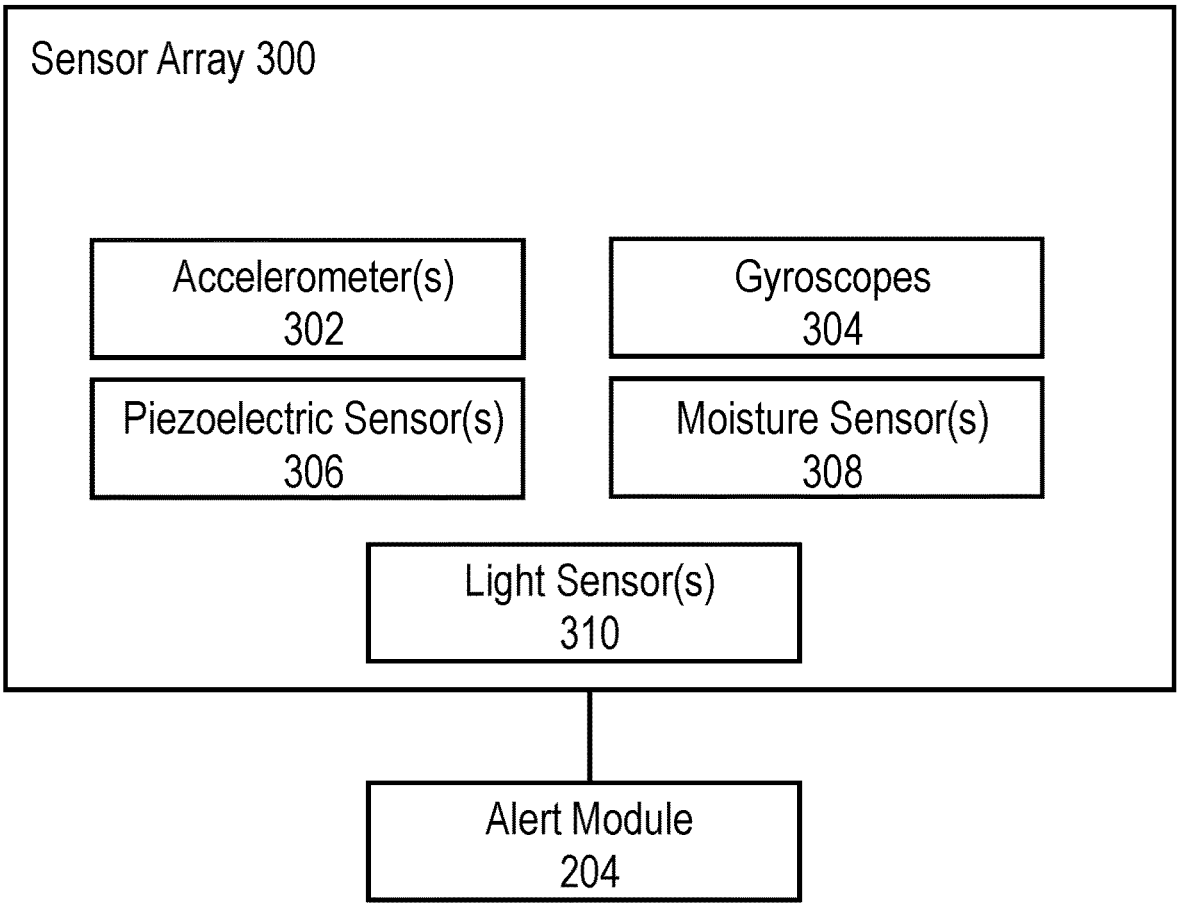
FIG. 3 illustrates a block diagram of the headgear sensor array, according to some embodiments.

FIG. 3 illustrates a block diagram of the sensor array 300 comprising a plurality of sensors, which are provided on the headgear 100. For example, the sensors may be provided on any combination of the following: the exterior surface 142 of the headgear 100, the interior surface of the headgear 100 (against the users skin or hair), and/or within the cushioned core component 110. The sensor array 300 may include one or more accelerometers 302, one or more gyroscopes 304, one or more piezoelectric sensors 306, one or more moisture sensors 308, and one or more light sensors 310. For example, the accelerometers 302 may measure impact to the headgear and output an alert signal to the alert module 204 if an impact threshold is reached. In such, the lights 150 and/or speakers 130 may emit an output to signal the impact. In another example, the gyroscope 304 may determine that the user 120 has been knocked down and send an alert signal to the alert module 204, which outputs a signal to the display 140, which then reads "knockdown" or a similar phrase. In another example, the moisture sensors 308 may sense the presence of blood on the user 120.

In some embodiments, the display 140 illustrates the score of the bout by keeping a total of impacts sensed for the user 120. If both fighters in the bout are wearing the headgear 100 described hereinabove, the score of the bout may be illustrated in real-time.

Many different embodiments have been disclosed herein, in connection with the above description and the drawings. It will be understood that it would be unduly repetitious and obfuscating to describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

An equivalent substitution of two or more elements can be made for any one of the elements in the claims below or that a single element can be substituted for two or more elements in a claim. Although elements can be described above as acting in certain combinations and even initially claimed as such, it is to be expressly understood that one or more elements from a claimed combination can in some cases be excised from the combination and that the claimed combination can be directed to a subcombination or variation of a subcombination.

It will be appreciated by persons skilled in the art that the present embodiment is not limited to what has been particularly shown and described hereinabove. A variety of modifications and variations are possible in light of the above teachings without departing from the following claims.

What is claimed is:

1. A headgear apparatus, comprising:

a cushioned core component to provide impact resistance during an activity;

at least one chinstrap and at least one head strap to retain the headgear apparatus on the head of a user;

a display positioned on an exterior surface of the headgear apparatus; and a control module to receive input from a sensor array in response to a stimulus, wherein the sensor array comprises an accelerometer, a gyroscope, a moisture sensor, and a piezoelectric sensor.

2. The headgear apparatus of claim 1, wherein the cushioned core component is a gel.

3. The headgear apparatus of claim 1, further comprising a microprocessor in communication with a memory module.

4. The headgear apparatus of claim 3, further comprising at least one speaker to emit audio.

5. The headgear apparatus of claim 4, wherein the display counts impacts to the user and displays the number of impacts.

6. The headgear apparatus of claim 1, wherein the display is resettable by the user.

7. The headgear apparatus of claim 1, further comprising an attachment mechanism to permit the interface between the headgear apparatus and personal protective equipment.

8. A headgear apparatus, comprising:

a cushioned core component to provide impact resistance during an activity;

at least one chinstrap and at least one head strap to retain the headgear apparatus on the head of a user;

a display positioned on an exterior surface of the headgear apparatus;

a control module to receive input from a sensor array in response to a stimulus; and a sensor array in operable communication with the control module, the sensor array is configured to sense the stimulus, wherein the sensor array comprises an accelerometer, a gyroscope, a moisture sensor, and a piezoelectric sensor.

9. The headgear apparatus of claim 8, wherein the moisture sensor senses the presence of blood on the user.

10. The headgear apparatus of claim 9, wherein the accelerometer senses impact to the user's head.

11. The headgear apparatus of claim 10, wherein the gyroscope senses the orientation of the user.

12. The headgear apparatus of claim 8, wherein the cushioned core component is a gel.

13. The headgear apparatus of claim 8, further comprising a microprocessor in communication with a memory module.

14. The headgear apparatus of claim 13, further comprising at least one speaker to emit audio.

15. The headgear apparatus of claim 14, wherein the display counts impacts to the user and displays the number of impacts.

16. The headgear apparatus of claim 15, wherein the display is resettable by the user, via the control module.

17. The headgear apparatus of claim 8, further comprising an attachment mechanism to permit the interface between the headgear apparatus and personal protective equipment.

18. The headgear apparatus of claim 8, wherein the cushioned core component provides a low profile to the headgear apparatus.

19. A headgear apparatus, comprising:

a cushioned core component to provide impact resistance during an activity;

at least one chinstrap and at least one head strap to retain the headgear apparatus on the head of a user;

a display positioned on an exterior surface of the headgear apparatus;

a control module to receive input from a sensor array in response to a stimulus received by the sensor array, the sensor array comprising at least one of the following sensors: at least one accelerometer, at least one gyroscope, at least one moisture sensor, and at least one piezoelectric sensor, wherein each stimulus received by the sensors corresponds to an output signal transmitted to at least one speaker and at least one light, each positioned on the exterior surface of the headgear apparatus.

* * * * *